US006467618B2

(12) United States Patent
High et al.

(10) Patent No.: US 6,467,618 B2
(45) Date of Patent: Oct. 22, 2002

(54) TRAY FOR HOLDING SURGICAL TIP ATTACHMENTS

(75) Inventors: Alvin High; Leigh Marciniak, both of Baden, PA (US)

(73) Assignee: High Quality Surgical Repair, Baden, PA (US)

( * ) Notice: Subject to any disclaimer, the term of this patent is extended or adjusted under 35 U.S.C. 154(b) by 0 days.

(21) Appl. No.: 09/803,274

(22) Filed: Mar. 9, 2001

(65) Prior Publication Data

US 2002/0125158 A1 Sep. 12, 2002

(51) Int. Cl.[7] ..... B65D 85/20

(52) U.S. Cl. ..... 206/370; 206/459.5; 211/70.6; 220/676

(58) Field of Search ..... 206/363–379, 206/438, 459.5; 211/69, 70.6, 168, 171; 422/300; 220/676

(56) References Cited

U.S. PATENT DOCUMENTS

| | | | | | |
|---|---|---|---|---|---|
| 2,472,028 | A | * | 5/1949 | Son | 206/365 |
| 2,666,967 | A | | 1/1954 | Poitras | |
| 3,583,556 | A | * | 6/1971 | Wagner | 206/373 |
| 4,865,194 | A | * | 9/1989 | Decarie | 206/378 |
| 4,955,478 | A | * | 9/1990 | Rau et al. | 206/379 |
| 5,133,455 | A | | 7/1992 | Chow | |
| 5,172,810 | A | * | 12/1992 | Brewer | 206/369 |
| 5,174,453 | A | | 12/1992 | Stoeffler | |
| 5,312,250 | A | * | 5/1994 | Ellman et al. | 206/379 |
| 5,451,380 | A | | 9/1995 | Zinnanti | |
| 5,490,975 | A | * | 2/1996 | Dane | 206/379 |
| 5,711,428 | A | * | 1/1998 | Ho | 206/372 |
| 5,762,202 | A | | 6/1998 | Atad | |
| 5,848,693 | A | | 12/1998 | Davis et al. | |
| 5,931,318 | A | * | 8/1999 | Shauo | 206/378 |
| 6,070,732 | A | * | 6/2000 | Chen | 206/373 |
| 6,113,867 | A | | 9/2000 | Mayer | |
| 6,119,859 | A | * | 9/2000 | Wen | 206/379 |
| 6,155,439 | A | | 12/2000 | Draughn | |

* cited by examiner

*Primary Examiner*—Jim Foster
(74) *Attorney, Agent, or Firm*—Buchanan Ingersoll, P.C.

(57) ABSTRACT

The surgical tip attachment holder tray has a base, a pivot block pivotally connected to the base, and a plurality of threaded bases attached to the pivot block. The base has a perimeter having a first section and a second section, said perimeter having at least one wall attached to the base along the first section of the perimeter and defining an open end adjacent the second section of the perimeter. The pivot block is pivotally connected to one of the base section and at least one wall at the open end of said base in a manner so that the pivot block is spaced apart from the base a sufficient distance to allow liquid to pass between the pivot block and the base tray, and allowing said pivot block to rotate from a first position to a second position. The plurality of threaded bases attached to the pivot block on said threaded base receiving surface are adapted to receive a plurality of surgical tip attachments. The threaded bases have means to prevent overtightening of the surgical tip attachments while being mounted on the threaded bases.

15 Claims, 4 Drawing Sheets

TRAY FOR HOLDING SURGICAL TIP ATTACHMENTS

FIELD OF THE INVENTION

The invention relates to a novel device to hold surgical tip attachments in a holder tray to allow for easy exchange of surgical tips during a surgical procedure and to prevent the attachments from being lost or accidentally discarded after a surgical procedure by allowing the tips to be easily returned and secured to the holder tray. The construction of the holder tray allows for easy steam or chemical sterilization by allowing drainage of liquids from the holder tray while permitting stacking of the holder tray without damage.

BACKGROUND OF THE INVENTION

Surgical tips are used interchangeably on a surgical tool to provide different active surfaces to perform different tasks during a surgical procedure. In current practice, the surgical tips are typically stored loose, packaged individually or in sets in peel open packages called peel paks. The packages are opened before surgery and the implements are then placed on a tray or sterile cloth. There they can be knocked about and damaged making it difficult to retrieve the desired tip. The surgical tips are typically small in size and easily misplaced or lost during postoperative care and handling. They are frequently mistakenly discarded along with used surgical dressings or other post-surgical refuse. Also, because of their size, it is difficult to organize them in an orderly fashion for easy retrieval and identification after a surgical procedure. Typically, the surgical tips are stored loosely or peel paked and then handled again in attempts to organize them for a particular sequence of use in a surgical procedure. This practice increases the likelihood of loss or misplacement due to the extra-handling step following sterilization prior to or after a surgical procedure. This practice is cumbersome and time-consuming. consuming.

It is an object of the present invention to provide a device or holder tray to organize the surgical tips in an orderly fashion allowing for quick and easy retrieval of tips during a surgical procedure and for storage following a surgical procedure, permitting sterilization of the tips while mounted on the holder tray to solve the problems associated with current surgical tip storage, sterilization, and organization for use in a surgical procedure.

It is a further object of the invention to provide a holder tray with a "flip up/flip down" feature rotating through 90 degrees from a horizontal to a vertical or upright position, lockable in the upright position, to allow for easy retrieval of surgical tip attachments organized on the holder tray, while permitting "flipping down" to a horizontal position to reduce risk of damage and to permit stacking of surgical tip attachment trays without risk of damage to surgical tip attachments.

It is a further object of the invention to provide a holder tray made of a material that is autoclavable and is configured to allow for easy drainage of liquids to minimize the likelihood of contamination of surgical tips prior to use in a surgical procedure following sterilization.

It is a further object of the invention to provide a holder tray for surgical tips using a common threaded connection common to all surgical tip attachments for a given use to be placed in any of the storage locations of the surgical tip attachment tray, and to provide a means to prevent over-tightening of the surgical tips to allow for easy retrieval of the surgical tip attachment. The invention provides a surgical tip attachment tray that allows surgical staff to easily identify a desired tip and securely replace the tip into the tray after use. It is a further object of the invention to provide a surgical tip attachment tray that is easy to use.

It is a further object of the invention to provide a holder tray to allow for sterilization of surgical tips while mounted on a threaded base and to provide a tray for storage of surgical tip attachments.

It is a final object of the invention to provide a surgical tip attachment holder tray sized so that it easily fits within a larger tray for holding additional hand held surgical instruments.

SUMMARY OF THE INVENTION

The surgical tip attachment tray holder is designed to hold a plurality of surgical tip attachments on a common threaded base allowing for positioning of any tip attachment in any storage location of the surgical tip attachment tray. The storage locations on a pivot block are spaced apart in a substantially linear alignment. A present preferred embodiment allows for eight storage locations so arranged. The number of storage locations can be varied to suit different applications. Tip attachment length and diameter do not dictate a specific storage location, giving the user flexibility in organizing the surgical tip attachments. The surgical tip attachments are held on connectors such as threaded bases that are mounted on a pivot block. The pivot block rotates from a first position in the well area of the holder tray, protected from damage to a lockable upright or second position permitting easy retrieval or replacing of the surgical tip attachments. The connectors can also be altered to be adapted to different surgical instruments. A preferred embodiment of the invention is made of a non-corrosive metal to be autoclavable and withstand sterilization. Because of its ability to be autoclaved, the surgical tip attachment holder is suitable for reuse if sterilized.

The surgical tip attachment holder tray comprises a base tray with at least one wall portion substantially perpendicular to the base tray, forming the well area of the tray having an open end. A pivot block having two ends is pivotally attached on each end to two perpendicular wall portions at the open end of the tray base by pivoting means. In a preferred embodiment, the pivot block is pivotally attached by shoulder screws. The pivot block comprises a first end and a second end, an inner side and an outer side, and an upper receiving surface and a lower surface. The pivot block rotates on the shoulder screws from a first substantially horizontal position to a second substantially vertical or upright position and is lockable in the second position by locking means. The receiving surface is substantially perpendicular to the tray base in the first position and is substantially parallel to the tray base in the second position. In a preferred embodiment, the locking means comprise a ball plunger threadedly connected to an end of the pivot block locking into a ball plunger aperture on the perpendicular wall portion opposite the ball plunger. The inner and outer sides are of different lengths so that the outer side is longer than the inner side to limit the range of rotation of the pivot block from the first position to the second position. The upper receiving surface is adapted to receive threaded bases or other connectors secured to the pivot block by a screw. In a preferred embodiment, the pivot block has eight threaded base storage positions arranged substantially linearly or staggered, spaced apart to allow for easy mounting and dismounting of surgical tip attachments. The bottom section of the threaded bases is non-circular. The receiving surface of the pivot blocks has recessed surfaces corresponding to the bottom section of the threaded base allowing the threaded base bottom section to fit within the recessed surface, preventing unwanted rotation of the threaded base during mounting or dismounting of a surgical tip attachment. The outer side of the pivot block has marking indicia so that the threaded base storage positions can be identified. The pivot block is positioned above the base tray to allow liquid to drain from the well area of the tray, in either the first or second position. The pivot block is recessed when in the first or horizontal position to allow stacking of surgical tip attachment trays.

In another embodiment of the invention, the locking means comprises a magnetic means of locking the pivot block in the second position for loading or unloading of surgical tip attachments. The magnetic means for locking comprise a magnet attached on the base tray and holds the pivot block in the second position for mounting or dismounting surgical tip attachments.

DETAILED DESCRIPTION OF THE PREFERRED EMBODIMENTS

Figure 1:
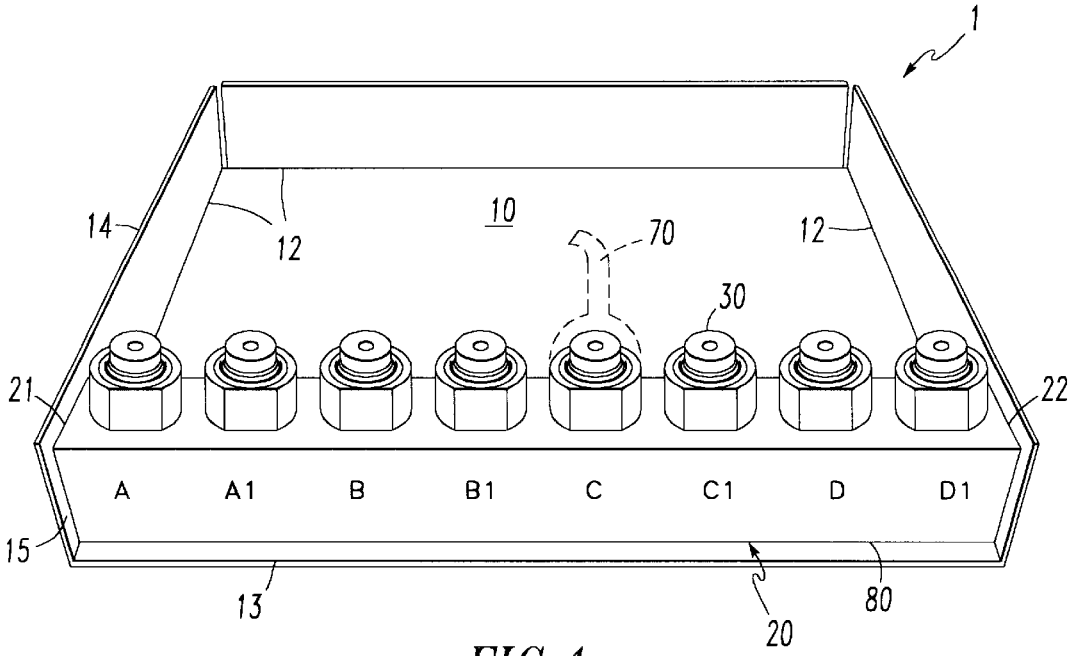
FIG. 1 is a front elevational perspective view of the surgical tip attachment holder tray.
Figure 2:
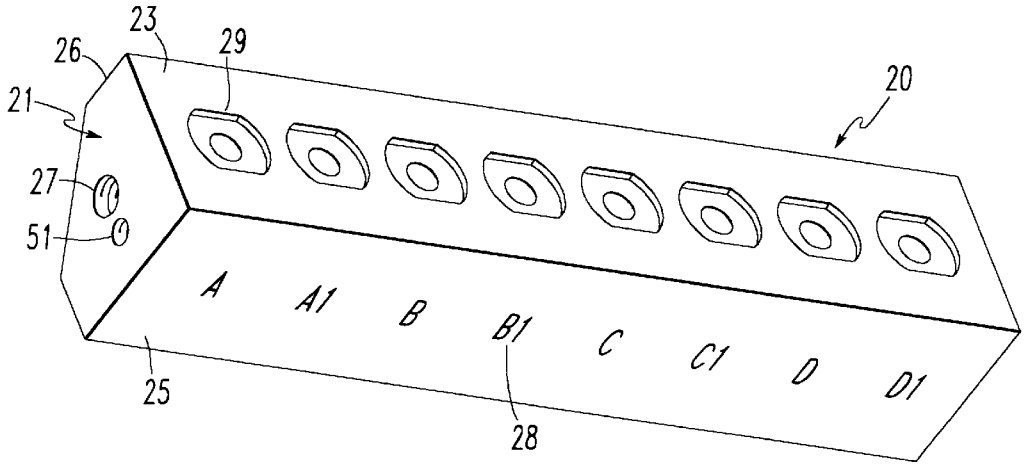
FIG. 2 is a perspective view of one end of the pivot block showing the outer surface, recesses on the receiving surface, the marking indicia on the outer side, the shorter inner side.
Figure 3:
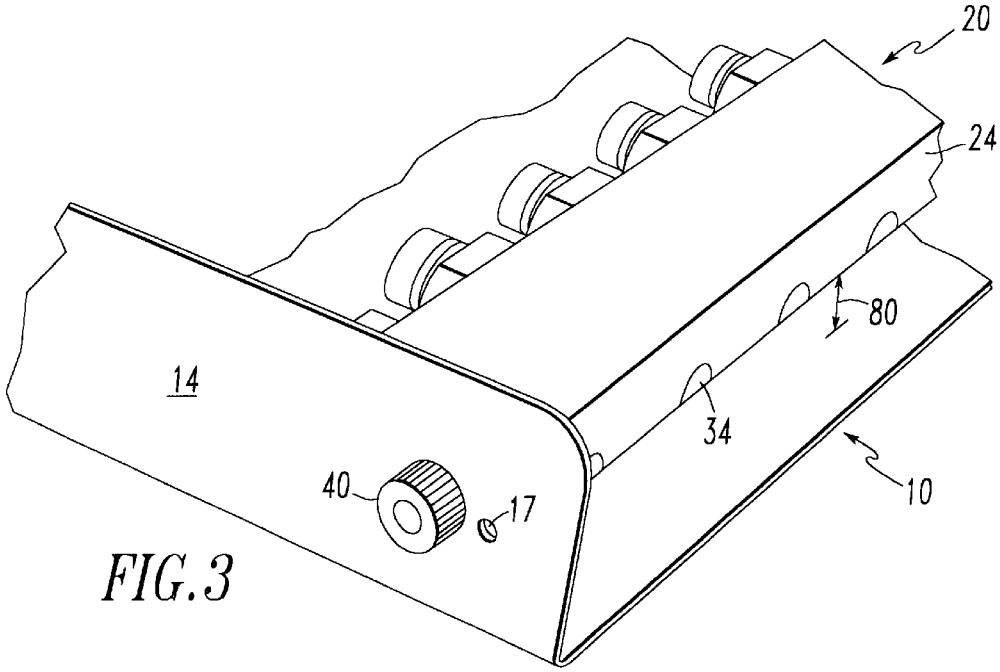
FIG. 3 is an isometric lateral view of one corner of the holder tray showing the pivot block locked in the first position.
Figure 4:
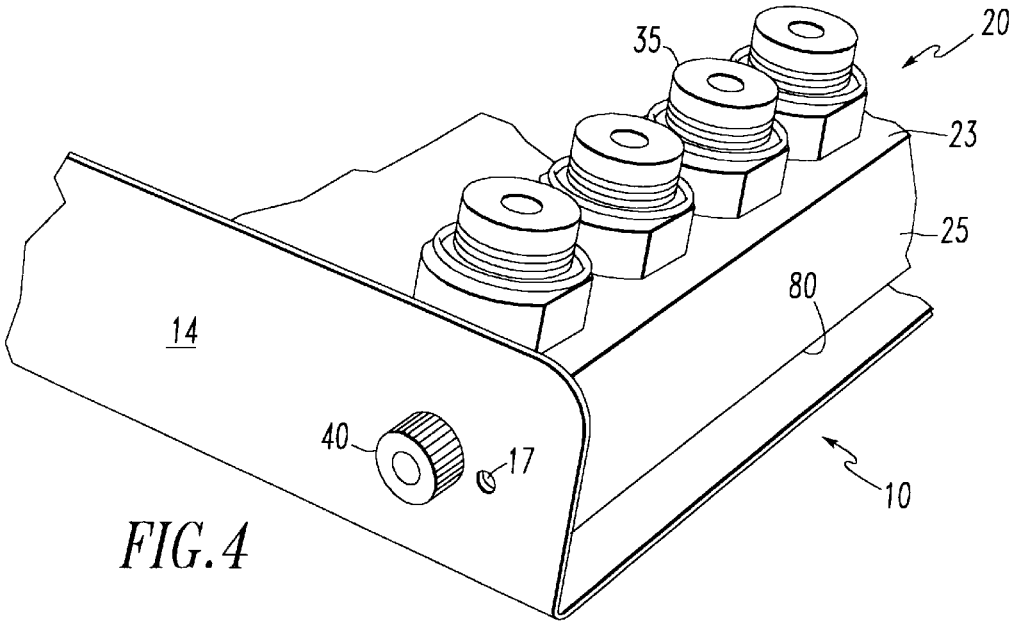
FIG. 4 is an isometric lateral view similar to FIG. 3 showing the pivot block in the second position.

As shown in the Figures, a present preferred embodiment of a surgical tip attachment holder tray 1 contains a base 10 having a perimeter with a first section 12 and a second section 13. At least one wall 14 is attached to the base along the first section 12 of the perimeter and defining an open end 15 adjacent to the second section of the perimeter. The surgical tip attachment holder tray also contains a pivot block 20 having a first end 21 having a pivot bore 27, a second end 22 having a similar bore, a receiving surface 23, a lower surface 24, an outer surface 25 having marking indicia 28, and an inner surface 26. The marking indicia may be the tip product number, color code or other marking that helps in easily identifying the surgical tip attachments on the holder tray. In a present preferred embodiment, the pivot block is pivotally attached to at least one wall 14 extending from the base by a shoulder screw 40 threaded through a shoulder screw aperture 16 on one of the two walls adjacent the open end of the base and into the pivot bore 27 on the pivot block. The pivot block 20 can be positioned in a first position substantially horizontal to the base 10, as shown in FIG. 3 or positioned in a second or upright position as shown in FIGS. 1 and 4. The pivot block 20 is locked in the second position by a ball plunger 50 attached to an end of the pivot block. There is on the wall 14 a ball plunger hole or detent 17 that receives the spring loaded ball of the ball plunger when the pivot block is rotated to the second position. The flat inner surface 26 prevents the block from pivoting too far thereby preventing tips attached to the block 20 from hitting the base 10 of the tray. Alternative embodiments of the pivot block include a rod or cylinder with a flattened receiving surface for mounting of the threaded bases, or other elongated configurations having a polygonal cross-section with a flattened receiving surface. If these shapes were used a stop would be added to prevent the block from turning too much in either direction. In a present preferred embodiment, the pivot block 20 has eight threaded bases 30 attached to the receiving surface 23 for mounting or dismounting of surgical tip attachments. Other trays may have more or fewer bases, typically from four to ten bases. Each threaded base 30 has a threaded receiving portion 31, a shoulder portion 32, and an O-ring 33 to prevent overtightening of the surgical tips being mounted. Alternatively one could prevent overtightening by using a lock washer, or alignment marks on the receiving surface and on the threaded base. The threaded bases are attached to the pivot block by a head cap screw 34 through the pivot block. In FIG. 1, a surgical tip attachment 70 is shown in dotted lines threaded onto a threaded base 30. In order to prevent unwanted rotation of the threaded bases during mounting or dismounting of surgical tips on the threaded base, the threaded base has a non-circular bottom 35 within a similarly shaped recessed surface 29 on the receiving surface of the pivot block. Although base 30 is shown as having threads, a quick disconnect coupling or other connector could be used. The surgical tip attachment tray holder preferably is constructed of a material that is suitable for sterilization methods typically used in a surgical facility including heat, chemical, steam, and autoclaving. In the present preferred embodiment the surgical tip attachment holder tray is made of metal such as stainless steel, other corrosion resistant alloys, brass, or anodized aluminum. In an alternative embodiment, the surgical tip attachment tray is made of PVC or other commonly used plastics resistant to sterilization methods commonly used by surgical facilities. The advantage of the present invention is the position of the pivot block above the base creating a drainage space 80 to allow liquids to drain from the base with the pivot block in either the first or second position.

Figure 5:
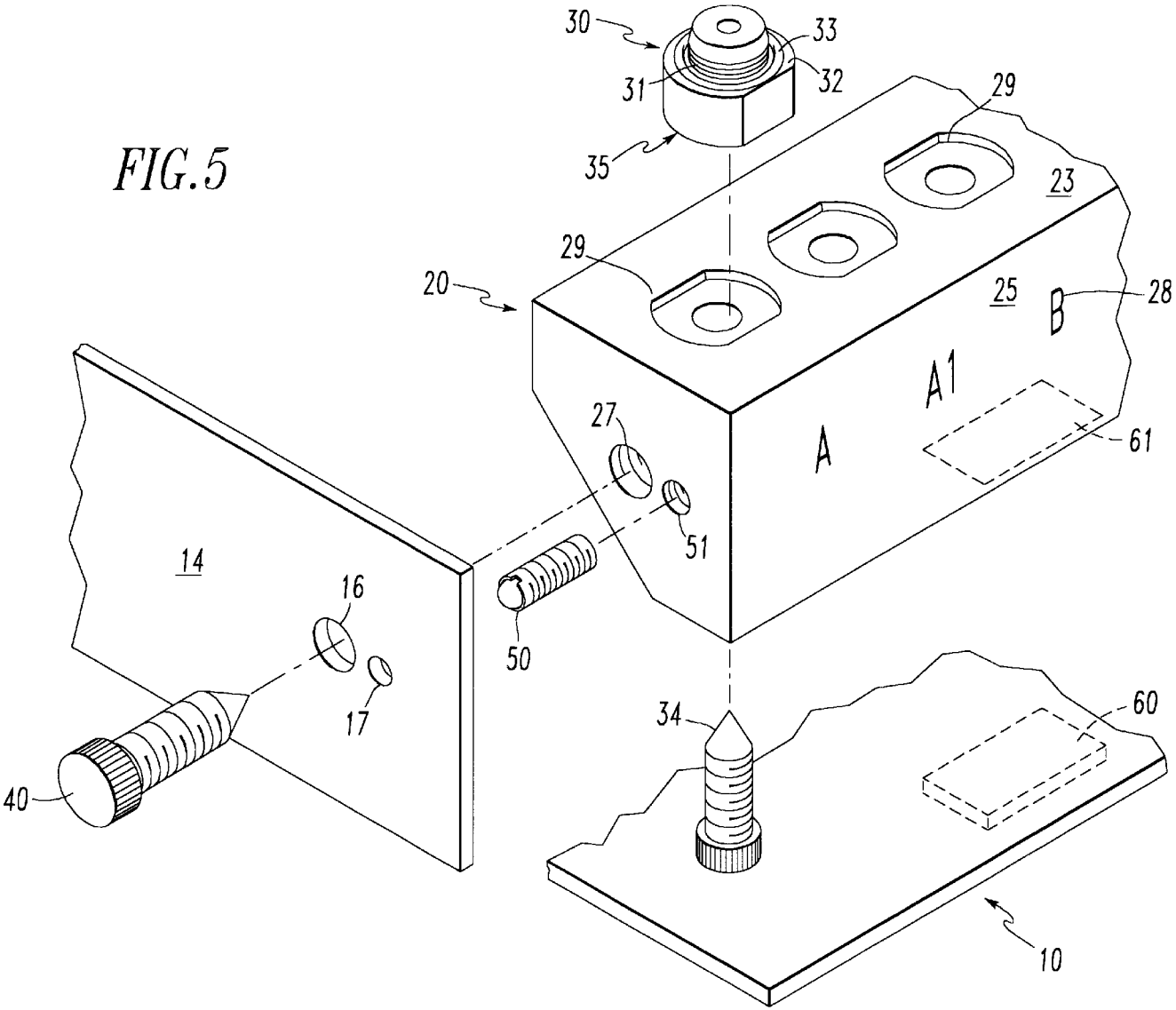
FIG. 5 is an exploded view of the portion of the tray shown in FIGS. 3 and 4.

As shown in FIG. 5, an alternative means of locking the pivot block 20 in a second position contains a magnet 60 attached to the base 10 adjacent to the open end 15. The magnet 60 is positioned so that the pivot block when made of metal is locked in the second position for mounting or dismounting of surgical tips. In an alternative embodiment when the invention is made of PVC or another non-magnetic material, the pivot block 20 also has a metal strip 61 attached to the lower surface of the pivot block to lock with the magnet and lock the pivot block in the second position. In one embodiment as shown in FIG. 3, we prefer the wall 14 to extend above the outer surface 25 when the pivot block 20 is in the first position, to allow stacking of surgical tip attachment holder trays or other trays on the surgical tip attachment holder tray without damaging the surgical tips.

Figure 6:
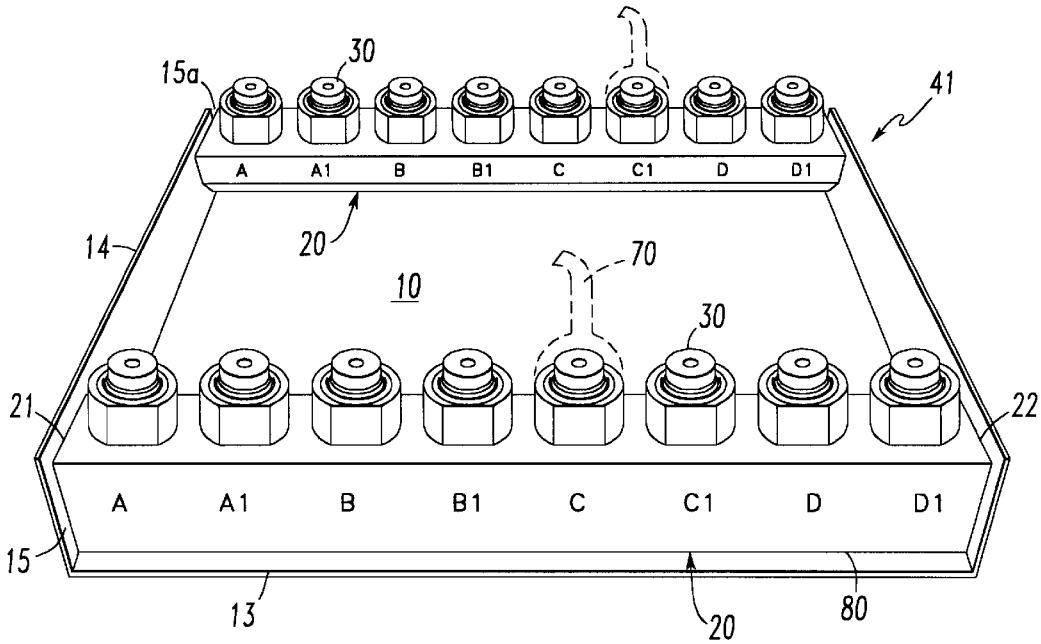
FIG. 6 is an elevational view of a second preferred embodiment of our surgical tip attachment holder tray.

A second present preferred embodiment of our surgical tip attachment holder tray 41 is shown in FIG. 6. This embodiment has two pivot blocks 20, one at each open end as shown. Consequently, there are two parallel walls 14 extending from the base and two open ends 15 and 15*a*. The threaded bases are preferably positioned so that tips attached to bases at opposite ends will nest between one another when the blocks are pivoted to a down position.

Figure 7:
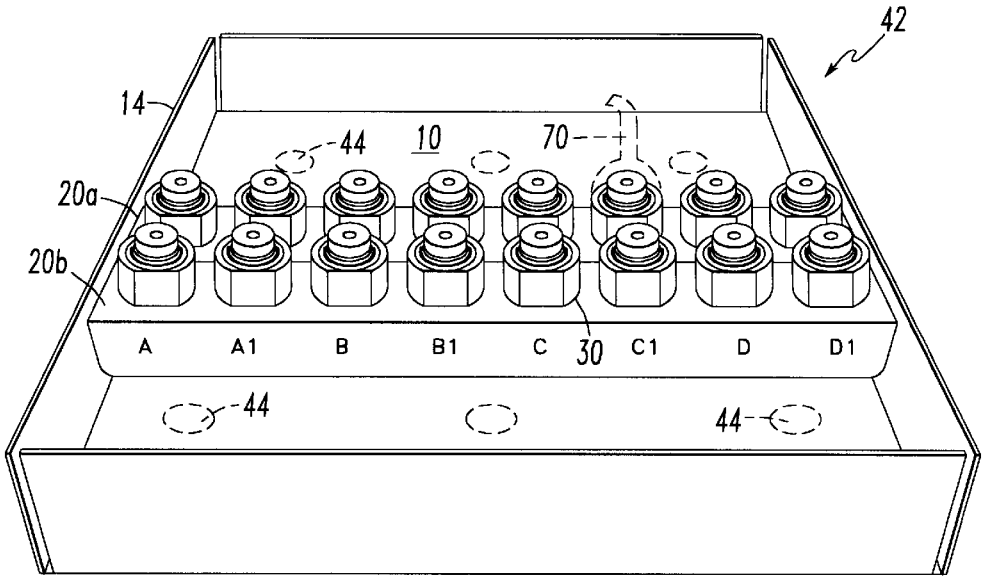
FIG. 7 is an elevational view of a third preferred embodiment of our surgical tip attachment tray.

A third embodiment 42 shown in FIG. 7 has four walls 14 extending from the base 10 which do not meet at the corners.

Thus, liquid can flow from the tray through the gaps between the walls of the corners. Optional drain holes 44 may be provided in the base. There are two pivot blocks 20 in the center of the tray that pivot in opposite directions.

Although we have shown and described certain present preferred embodiments of our invention, it should be understood that our invention is not limited thereto but may be variously embodied within the scope of the following claims.

What is claimed is:

1. A surgical tip attachment holder tray, comprising:

a) a base comprising a perimeter containing a first section and a second section, and at least one wall attached to the base along the first section of the perimeter and defining an open end adjacent the second section of the perimeter;

b) a pivot block having a first end and a second end, a receiving surface, a lower surface, an outer surface and an inner surface, said pivot block pivotally connected to one of the base section and at least one wall at the open end of said base in a manner so that the pivot block is spaced apart from the base a sufficient distance to allow liquid to pass between the pivot block and the base, and allowing said pivot block to rotate from a first position to a second position, wherein the pivot block is pivotally connected to the base by a pair of shoulder screws, each shoulder screw threaded through a shoulder screw aperture on one of the two walls adjacent the open end of the base and into one end of the pivot block; and c) a plurality of connectors attached to said pivot block on said receiving surface, each of said connectors adapted to receive a surgical tip attachment.

2. The surgical tip attachment holder tray of claim 1, further comprising a ball plunger threadedly connected to the first end of the pivot block and positioned to protrude into a ball plunger detent provided on a wall, the detent positioned to be adjacent to the ball plunger when said pivot block is in the second position.

3. A surgical tip attachment holder tray, comprising:

a) a base comprising a perimeter containing a first section and a second section, and at least one wall attached to the base along the first section of the perimeter and defining an open end adjacent the second section of the perimeter;

b) a pivot block having a first end and a second end, a receiving surface, a lower surface, an outer surface and an inner surface, said pivot block pivotally connected to one of the base section and at least one wall at the open end of said base in a manner so that the pivot block is spaced apart from the base a sufficient distance to allow liquid to pass between the pivot block and the base, and allowing said pivot block to rotate from a first position to a second position; and c) a plurality of connectors attached to said pivot block on said receiving surface, each of said connectors adapted to receive a surgical tip attachment, wherein the connectors are each threadedly connected to the pivot block by a screw extending through the pivot block.

4. A surgical tip attachment holder tray, comprising:

a) a base comprising a perimeter containing a first section and a second section, and at least one wall attached to the base along the first section of the perimeter and defining an open end adjacent the second section of the perimeter;

b) a pivot block having a first end and a second end, a receiving surface, a lower surface, an outer surface and an inner surface, said pivot block pivotally connected to one of the base section and at least one wall at the open end of said base in a manner so that the pivot block is spaced apart from the base a sufficient distance to allow liquid to pass between the pivot block and the base, and allowing said pivot block to rotate from a first position to a second position;

c) a plurality of connectors attached to said pivot block on said receiving surface, each of said connectors adapted to receive a surgical tip attachment; and d) means to prevent unwanted rotation of the connector when a surgical tip is installed or removed from said surgical tip attachment tray.

5. The surgical tip attachment holder tray of claim 4, wherein the means to prevent unwanted rotation is a recessed surface on the pivot block receiving surface whose cross section conforms to a bottom of the connector, allowing the connector bottom to fit within the recessed surface.

6. The surgical tip attachment holder tray of claim 3, wherein each connector comprises a shoulder portion at a base of a threaded receiving portion, the shoulder portion having a means for preventing overtightening of a surgical tip attachment being secured.

7. The surgical tip attachment holder tray of claim 6, wherein said means for preventing overtightening comprises an O-ring at the base of said threaded receiving portion.

8. The surgical tip attachment holder tray of claims 1, 3 or 4, wherein said surgical tip attachment tray is made of a material suitable for sterilization.

9. The surgical tip attachment holder tray of claim 8, wherein the base, wall and the pivot block are made of a metal selected from the group consisting of stainless steel, corrosion resistant alloys, brass and anodized aluminum.

10. A surgical tip attachment holder tray, comprising:

a) a base comprising a perimeter containing a first section and a second section, and at least one wall attached to the base along the first section of the perimeter and defining an open end adjacent the second section of the perimeter;

b) a pivot block having a first end and a second end, a receiving surface, a lower surface, an outer surface and an inner surface, said pivot block pivotally connected to one of the base section and at least one wall at the open end of said base in a manner so that the pivot block is spaced apart from the base a sufficient distance to allow liquid to pass between the pivot block and the base, and allowing said pivot block to rotate from a first position to a second position, wherein the pivot block outer surface has marking indicia for identifying the surgical tip attachments mounted on the threaded base; and c) a plurality of connectors attached to said pivot block on said receiving surface, each of said connectors adapted to receive a surgical tip attachment.

11. A surgical tip attachment holder tray, comprising:

a) a base comprising a perimeter containing a first section and a second section, and at least one wall attached to the base along the first section of the perimeter and defining an open end adjacent the second section of the perimeter;

b) a pivot block having a first end and a second end, a receiving surface, a lower surface, an outer surface and an inner surface, said pivot block pivotally connected to one of the base section and at least one wall at the open end of said base in a manner so that the pivot block is spaced apart from the base a sufficient distance to allow liquid to pass between the pivot block and the base, and allowing said pivot block to rotate from a first position to a second position; and c) from four to ten threaded bases on said pivot block, each threaded base adapted to receive a surgical tip attachment.

12. A surgical tip attachment holder tray, comprising:

a) a base comprising a pair of walls attached to the base, said walls spaced apart and defining two open ends opposite each other, b) a pair of pivot blocks, each pivot block having a first end and a second end, a receiving surface, a lower surface, and an outer surface, one pivot block pivotally connected to each wall at each open end of said base in a manner so that each pivot block is spaced apart from the base a sufficient distance to allow liquid to pass between the pivot block and the base tray, and allowing each pivot block to rotate from a first position to a second position; and c) a plurality of connectors attached to each said pivot block on said receiving surface, said connectors adapted to receive a plurality of surgical tip attachments.

13. The surgical tip attachment holder tray of claim 12, wherein the connectors on the pivot blocks are positioned so that surgical tips mounted on the connectors are nested when the pivot blocks are in the down position.

14. A surgical tip attachment holder tray, comprising:

a) a base comprising a bottom having a pair of spaced apart generally parallel side walls extending from two substantially parallel edges of the bottom, the bottom having at least two additional edges;

b) an additional wall extending from each additional edge, each additional wall being spaced apart from a side wall such that there is a gap between the additional wall and the side wall;

c) a pair of pivot blocks, each pivot block having a first end and a second end, a receiving surface, a lower surface, and an outer surface, each pivot block pivotally connected to each side wall near a center of said base in a manner so that each pivot block is spaced apart from the base a sufficient distance to allow liquid to pass between the pivot block and the base tray, and allowing each pivot block to rotate from a first position to a second position; and d) a plurality of connectors attached to each said pivot block on said receiving surface, each of said connectors adapted to receive a surgical tip attachment.

15. The surgical tip attachment holder tray of claim 14, wherein the base has at least one drain hole to allow for additional drainage of liquid from the base.

* * * * *